US005398425A

United States Patent [19]

Cherry et al.

[11] Patent Number: 5,398,425

[45] Date of Patent: Mar. 21, 1995

[54] EASY-CLEANING INFRA-RED OVEN

[76] Inventors: Thomas A. Cherry, 4108 E. Base Rd., Greensburg, Ind. 47240; Steven R. Lipple, 4351 Reilly, Troy, Mich. 48098; Dennis G. Schmalzel, 16396 Almont Rd., Allentown, Mich. 48002

[21] Appl. No.: 185,499

[22] Filed: Jan. 24, 1994

[51] Int. Cl.[6] ..... F26B 19/00

[52] U.S. Cl. ..... 34/270; 34/272; 219/546

[58] Field of Search ..... 34/270, 271, 272, 266, 34/268, 269, 519, 520; 219/546–548

[56] References Cited

U.S. PATENT DOCUMENTS

| | | | |
|---|---|---|---|
| 2,369,803 | 2/1945 | Sardeson | 34/266 |
| 2,387,516 | 10/1945 | Kaminski | 34/266 |
| 2,918,560 | 12/1959 | Kruse | 219/546 |
| 3,102,942 | 9/1963 | LeFebvre | 34/519 |
| 4,494,316 | 1/1985 | Stephansen et al. | 34/266 |
| 4,943,447 | 7/1990 | Nelson et al. | 427/55 |
| 4,967,487 | 11/1990 | Urquhart | 34/270 |
| 5,010,659 | 4/1991 | Treleven | 34/269 |

*Primary Examiner*—Henry A. Bennett
*Assistant Examiner*—William C. Doerrler
*Attorney, Agent, or Firm*—Barnes, Kisselle, Raisch, Choate, Whittemore & Hulbert

[57] ABSTRACT

An oven has heating units to dry the paint on a freshly painted automotive vehicle. Each heating unit has infra-red tubes mounted on a frame. A reflector plate having a reflecting surface is provided behind the frame. The frame is mounted for swinging movement from an operative position adjacent to the reflecting surface of the reflector plate to an inoperative position allowing access to the reflecting surface to enable the reflecting surface to be cleaned. A quick acting latch is provided to releasably secure the frame in its operative position.

3 Claims, 3 Drawing Sheets

EASY-CLEANING INFRA-RED OVEN

FIELD OF THE INVENTION

This invention relates generally to drying ovens and more particularly to an easy-to-clean oven for drying paint on automotive vehicle bodies.

BACKGROUND OF THE INVENTION

After a motor vehicle body is painted, it is placed in an oven having drying elements such as infra-red tubes to dry the paint. To promote and accelerate the drying process, reflector plates are typically mounted behind the infra-red tubes. From time to time, the reflector plates become dirty or clouded and need to be cleaned in order to maintain their effectiveness. At present, the infra-red tubes must be removed one by one to reach and clean each reflector plate. The individual removal of the tubes is difficult and time consuming.

SUMMARY OF THE INVENTION

In accordance with the present invention, the drying elements or tubes are mounted over the reflector plate on a hinged frame. When it is desired to gain access to a reflector plate to clean it, or for any purpose, the hinged frame and tubes are pivoted as a unit away from the reflector plate. After the plate is cleaned, the frame is repositioned in operative position over the reflector plate and secured in place by one or more quick acting latches.

One object of this invention is to provide a drying oven in which the reflector plates are readily accessible for quick and easy cleaning, and the heater tubes are readily accessible for cleaning and replacement.

Another object is to provide a drying oven which is composed of a relatively few simple parts, is rugged and durable in use, and which may be readily and inexpensively manufactured and assembled.

BRIEF DESCRIPTION OF THE DRAWINGS

These and other objects, features and advantages of the invention will be apparent from the following detailed description, appended claims and accompanying drawings in which:

DETAILED DESCRIPTION

Figure 4:
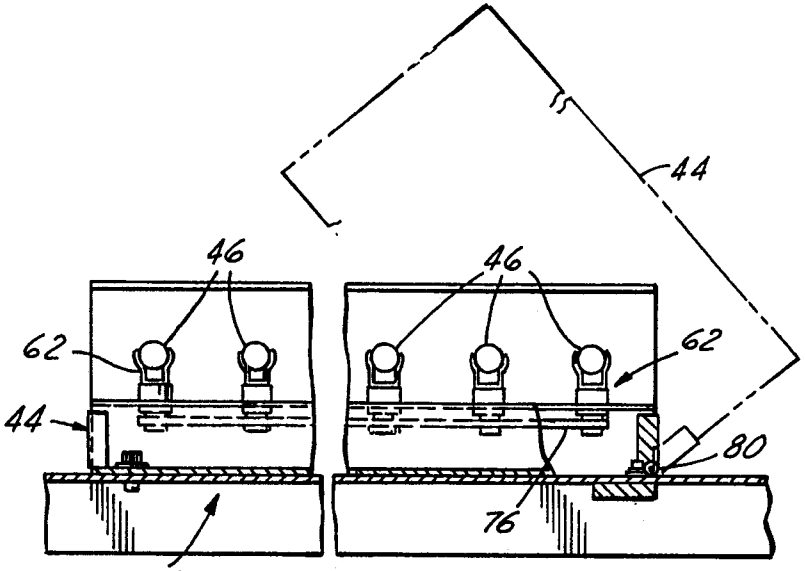
FIG. 4 is a sectional view taken on the line 4—4 in FIG. 3.
Figure 1:
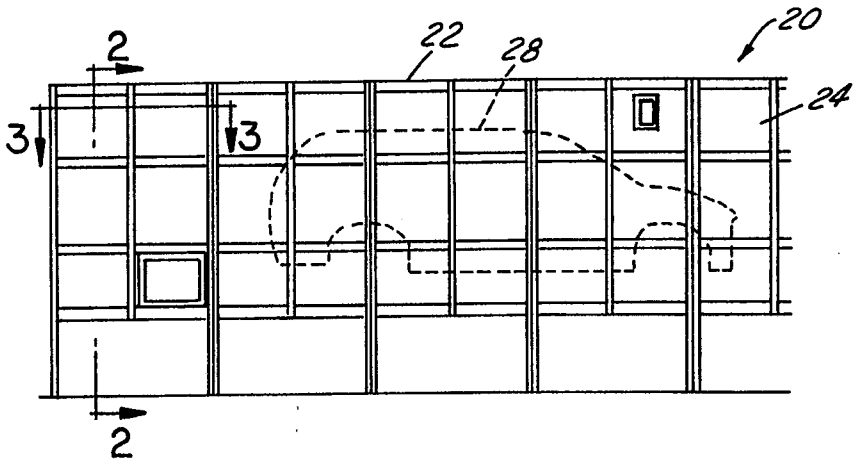
FIG. 1 is a side view of a portion of a drying oven for drying the paint on a motor vehicle body or the like, constructed in accordance with the invention.

Referring in more detail to the drawings, a drying oven or booth 20 has a top wall 22 and sidewalls 24 defining an enclosure 26 which is open at one end to admit a vehicle body 28. A freshly painted vehicle body is shown supported in the enclosure on a carrier 29. To promote drying of the paint, two banks 30 and 32 of heating units are provided, one on either side of the vehicle body. The banks 30 and 32 of heating units in this instance are identical to each other.

While the number and placement of the heating units may vary, in this instance, each bank has a top horizontal row of heating units 34, a bottom horizontal row of heating units 36 and two intermediate horizontal rows of heating units 38 and 40. All of the heating units in each bank are supported on a framework 42.

Each of the heating units 34–40 comprises a frame 44 on which is mounted a plurality of heating elements 46 and a reflector plate 48. The size of the individual heating units and the number of heating elements they carry may vary, but each is essentially of the same construction.

Figure 2:
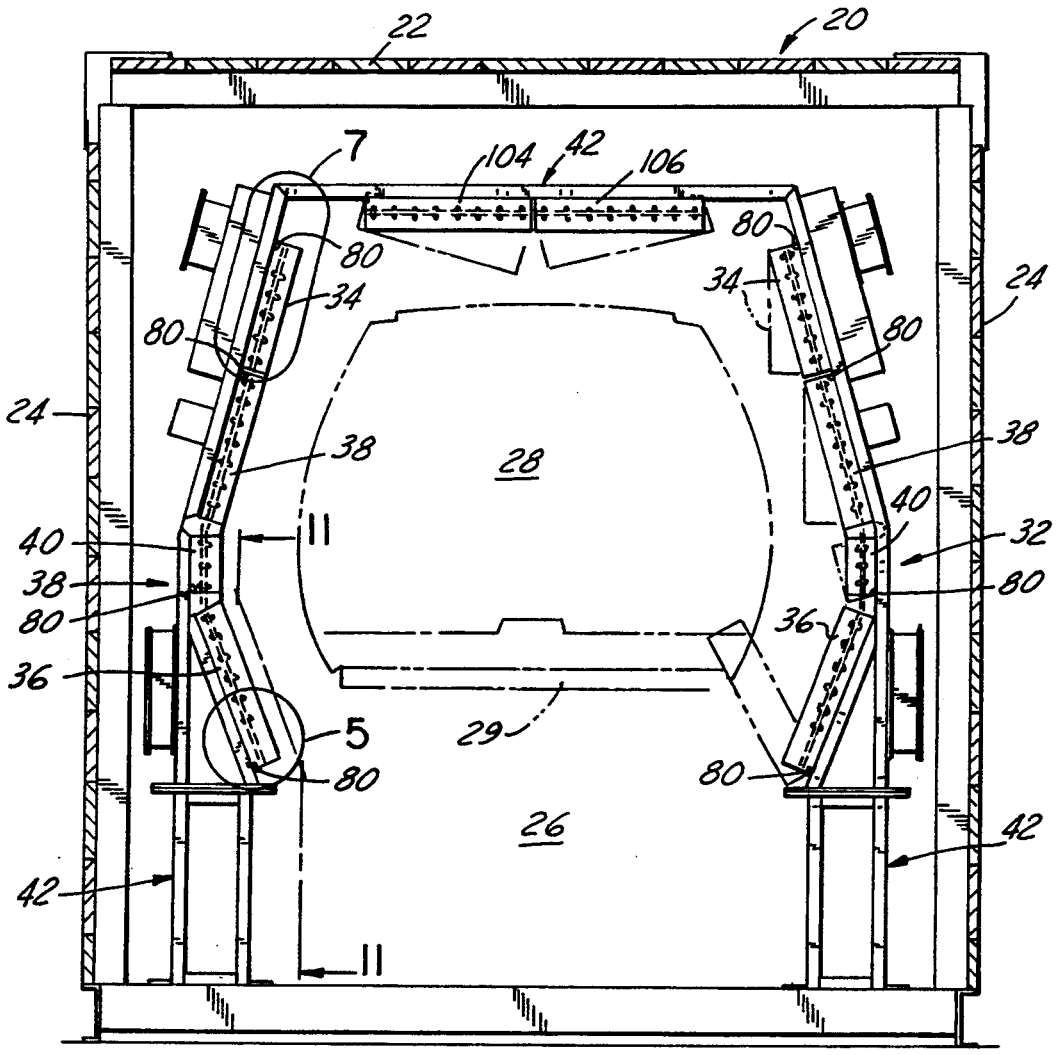
FIG. 2 is a view taken on the line 2—2 in FIG. 1, with parts in elevation and parts in section.
Figure 5:
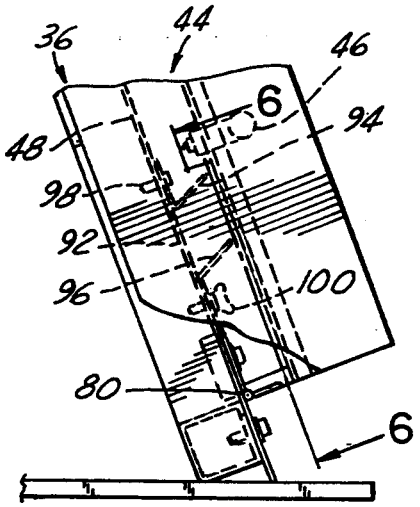
FIG. 5 is an enlarged view of the portion of FIG. 2 within circle 5.
Figure 6:
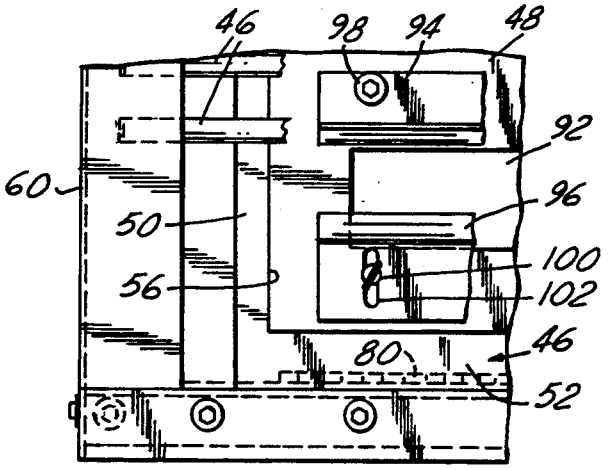
FIG. 6 is a view taken on the line 6—6 in FIG. 5.
Figure 7:
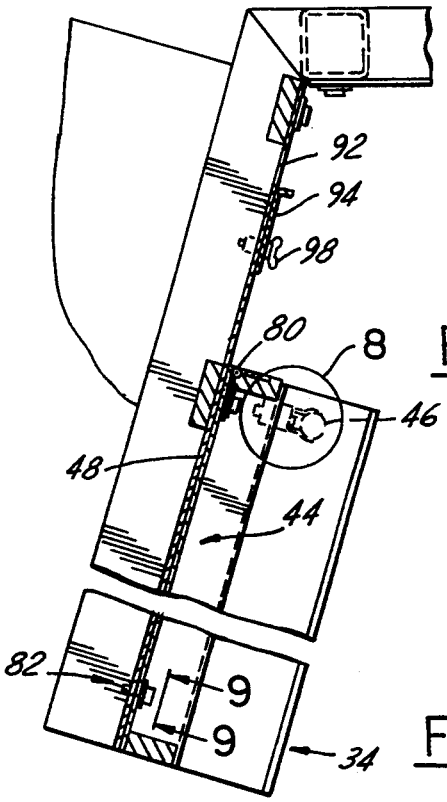
FIG. 7 is an enlarged view of the portion of FIG. 2 within the loop 7.
Figure 8:
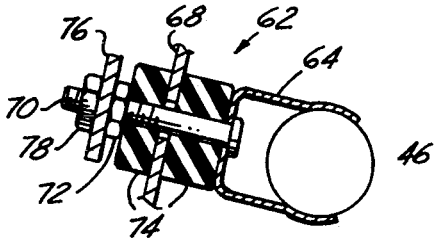
FIG. 8 is an enlarged view of the portion of FIG. 7 shown within the circle 8.
Figure 11:
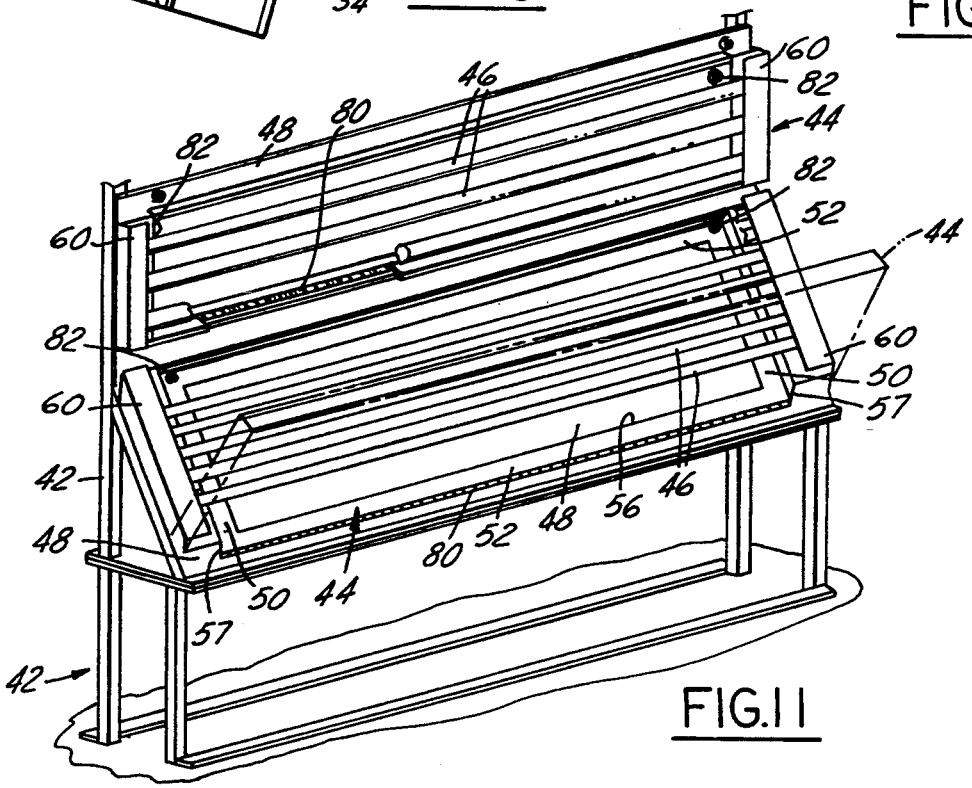
FIG. 11 is a perspective view taken on the line 11—11 in FIG. 2.

The reflector plate 48 of each heating unit is rigidly secured to the framework 42 and has a polished heat reflecting surface facing inwardly toward the vehicle body. The frame 44 of each heating unit is pivoted for swinging movement between operative and inoperative positions. In the operative position, the frame extends generally parallel to the reflector plate and extends across and covers the reflecting surface. In the inoperative position, the frame is swung away from the reflector plate. Some of the frames 44 in FIGS. 2, 4 and 11 are shown in dot-dash lines in their inoperative positions. Otherwise, the frames are illustrated in their-operative positions.

The frame 44 of each heating unit is rectangular in shape and preferably of one-piece construction. The frame 44 has spaced apart side frame bars 50 and spaced apart top and bottom frame bars 52 connected together end to end. The frame bars 50 and 52 are preferably in the form of elongated generally flat plates which are in the same plane and cooperate in defining a rectangular opening 56. At their laterally outer edges, the side frame bars 50 have flanges 57. The flanges 57 are generally perpendicular to the side frame bars 50 and extend away from the reflector plate 48 and terminate in elongated, laterally inwardly opening channels 60. Channels 60 confront one another and extend along substantially the full length of the side bars.

The heating elements 46 are preferably elongated, parallel, spaced apart infra-red tubes which extend across the opening 56 from one side frame bar to the other. The ends of each tube are releasably mounted in the channels 60 of the side frame bars. Each mount 62 for the tube ends comprises a channel-shaped clip 64 of flexible, resilient material. The sidewalls of the clip have confronting, concave or arcuately curved outer end portions which cooperate in gripping a tube end. The clip is mounted to the sidewall 68 of a channel 60 on a bolt 70. The bolt 70 extends through the base of the clip and through a hole in the sidewall 68 of the channel and is secured to the sidewall by a nut 72. Insulators 74 on the bolt 70 are provided on opposite sides of the sidewall 68. All of the tubes 46 of each heating unit have their ends electrically connected to elongated bus bars 76. The bus bars are outside of the channels and clamped to bolts 70 by nuts 78. One of the bus bars is shown connected by a cable 79 to any convenient source of electrical energy.

Each frame 44 is hinged to a reflector plate 48 by a piano hinge 80 which is connected to and extends along substantially the full length of either the top or the bottom frame bar 52. When the frame 44 is in its operative position generally parallel to its reflector plate 48, the flat frame bars 50 and 52 preferably are disposed flush against the reflector plate.

Figure 9:
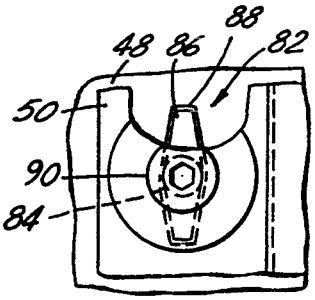
FIG. 9 is a fragmentary view taken on the line 9—9 in FIG. 7.
Figure 10:
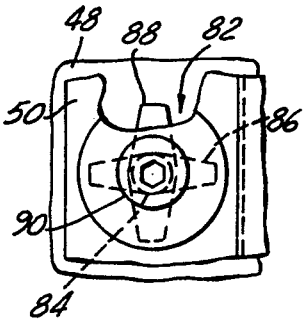
FIG. 10 is a view similar to FIG. 9 but with the parts in a different position.

Each frame is releasably retained in its operative position by at least one latch 82. The latches may be of the push button or twist type and provide quick release. The latches 82 are shown as twist type fasteners and each has a shank 84 rotatably mounted on one of the side frame bars 50. The shank 84 has a cross member 86 on the end adjacent the reflector plate 48, which is adapted to enter an elongated opening 88 in the reflector plate when the frame 44 is swung to its operative position against the reflector plate (See FIG. 9). A knob 90 on the opposite end of the shank 84 is used to rotate the shank 90° to its latched position (FIG. 10) thereby retaining the frame in its operative position. The knob can be turned by hand or by an appropriate tool inserted between the tubes 46. In this position, the bus bars 76 are in the space 91 between the reflector plate 48 and the channels 60 of the side frame bars 50.

The reflector plates 48 may have openings 92 for the circulation of air. Baffle plates 94 and 96 direct the flow of air through openings 92. Baffle plate 94 is secured to reflector plate 48 in fixed position by fastener 98. Baffle plate 96 is secured to the reflector plate in adjusted position by a fastener 100 extending through an elongated slot 102 in the baffle plate.

As seen in FIG. 2, additional heating units 104 and 106, of the same construction as heating units 34–40, may be provided in the top wall 22 of the oven.

When it becomes necessary or desirable to gain access to a reflector plate 48 to clean it, or for any purpose, the latch 82 is released by reverse rotation and the frame 44 is swung away from the reflector plate as shown in dot-dash lines in FIGS. 2, 4 and 11.

It will thus be seen that a reflector plate may be quickly and easily cleaned by merely swinging the frame 44 and infra-red tubes as a unit away from the reflector plates, without the necessity of removing the individual infra-red tubes one by one. This also provides ready access to the infra-red tubes for cleaning them without removal from their mounting clips 64 and for removing and replacing them.

Figure 3:
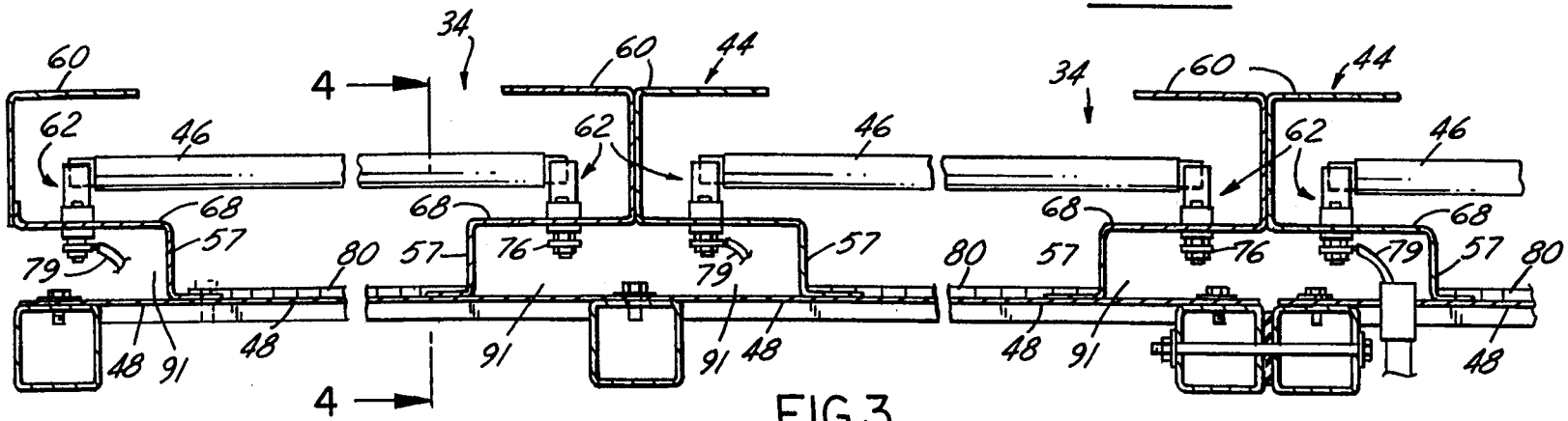
FIG. 3 is a sectional view taken on the line 3—3 in FIG. 2.

The ends of the infra-red tubes and their mounts 62 are protected and concealed from view by reason of there being disposed within the channels 60 of the side frame bars 50. The bus bars 76 are likewise protected and concealed when the frames 44 are retained in their operative positions by the latches 82, as seen in FIG. 3. The channels 60 of adjacent frames 44 in each row substantially contact one another when in operative position as shown in FIG. 3 to effectively close the spaces occupied by the bus bars 76 and defined by the reflector plates 48 and channels 60.

What is claimed is:

1. Apparatus for drying paint on a vehicle body comprising a drying unit, and means mounting said drying unit adjacent to a painted vehicle body, each drying unit comprising:

(a) a reflector plate having a reflecting surface, (b) a frame comprising elongated spaced apart side frame bars and elongated spaced apart end frame bars connected end-to-end to define an opening, (c) heating elements carried by said frame, (d) means pivotally attached to one of said end frame bars mounting said frame for swinging movement away from an operative position adjacent to the reflecting surface of said reflector plate to an inoperative position allowing access to said reflecting surface to enable the reflecting surface to be cleaned, (e) said heating elements comprising elongated parallel tubes extending across said opening between said side frame bars, (f) each of said side frame bars having a channel extending along substantially the full length thereof, said channels projecting laterally outwardly from said side frame bars and in spaced relation to said reflector plate when said frame is in said operative position, (g) said channels opening toward one another and receiving the ends of said tubes so that said tube ends are protected and concealed by said channels, (h) means individually and releasably securing the ends of the tubes in said channels, (i) bus bars attached to said respective channels exteriorly thereof and electrically connected to the ends of the tubes therein, said bus bars, when said frame is in said operative position, occupying the space between said channels and said reflector plate to be protected and concealed thereby, (j) and releasable means for securing said frame in its operative position.

2. Apparatus for drying paint on a vehicle body comprising two drying units, and means mounting said drying units adjacent to a painted vehicle body, wherein each drying unit comprises:

(a) a reflector plate having a reflecting surface, (b) a frame comprising elongated spaced apart side frame bars and elongated spaced apart end frame bars connected end-to-end to define an opening, (c) heating elements carried by said frame, (d) means pivotally attached to one of said end frame bars mounting said frame for swinging movement away from an operative position adjacent to the reflecting surface of said reflector plate to an inoperative position allowing access to said reflecting surface to enable the reflecting surface to be cleaned, (e) said heating elements comprising elongated parallel tubes extending across said opening between said side frame bars, (f) each of said side frame bars having a channel extending along substantially the full length thereof, said channels projecting laterally outwardly from said side frame bars, (g) said channels opening toward one another and receiving the ends of said tubes so that said tube ends are protected and concealed thereby, (h) means individually and releasably securing the ends of said tubes in said channels, (i) bus bars attached to said respective channels exteriorly thereof and electrically connected to the ends of the tubes therein, (j) and releasable means for securing each frame in its operative position, and wherein said two heating units are arranged side-by-side such that when the frames of said units are in operative position the adjacent channels thereof cooperate with said reflector plates to define a substantially closed space, said bus bars attached to said respective adjacent channels occupying said closed space to be protected and concealed thereby.

3. Apparatus as defined in claim 2, wherein said releasable means for securing each said frame in its operative position comprises a quick-acting fastener.

* * * * *